United States Patent [19]

Chen

[11] 4,082,281

[45] Apr. 4, 1978

[54] SHUTTLE ARTICLE FOR GAMES

[76] Inventor: Ping F. Chen, 7445 Plum Blossom Dr., San Jose, Calif. 95129

[21] Appl. No.: 695,531

[22] Filed: Jun. 14, 1976

[51] Int. Cl.[2] ..... A63B 67/18

[52] U.S. Cl. ..... 273/106 A

[58] Field of Search ..... 273/106 A, 106 R, 58 A

[56] References Cited

U.S. PATENT DOCUMENTS

| | | | |
|---|---|---|---|
| 2,117,928 | 5/1938 | Campbell | 273/58 A X |
| 2,218,593 | 10/1940 | Ushakoff | 273/106 A |
| 3,784,202 | 1/1974 | Pon | 273/106 A |

FOREIGN PATENT DOCUMENTS

| | | | |
|---|---|---|---|
| 200,044 | 10/1958 | Austria | 273/106 A |
| 824,778 | 12/1959 | United Kingdom | 273/106 A |

*Primary Examiner*—Paul E. Shapiro

*Attorney, Agent, or Firm*—Warren M. Becker

[57] ABSTRACT

Shuttle article for games comprising a circular plastic base member having a detachable rubber portion on its bottom, a neck portion on its upper surface, and a cone- or tear-shaped plastic chute flaring from the neck portion to an outer diameter at least twice that of the base member. The chute member is divided into thinly webbed plastic sections by eight plastic ribs which taper from the neck to the outer edges of the chute, with one of the sections being removed to provide an opening for achieving improved turn-around characteristics at the perigee and apogee of flight.

4 Claims, 3 Drawing Figures

SHUTTLE ARTICLE FOR GAMES

BACKGROUND OF THE INVENTION

This invention relates to a shuttle article for a game called Jien, in which the article is kicked into the air by the instep of a player's foot. The article is kicked again before it lands, and so on for as long as the player can keep it in motion.

Prior shuttle devices used in Jien have been constructed with feathers, similar to shuttlecocks. But such articles have been deficient in creating enough drag to produce adequate delay time for an average player's limited reaction time. Moreover, the features have not made possible true vertical travel of the shuttle article, which failing makes the game even more difficult to play.

SUMMARY OF THE INVENTION

In accordance with this invention, a shuttle article comprising a circular base member having a low-set neck portion and a chute member, which flares from the neck portion to an outer diameter twice that of the base member, is provided for achieving maximum delay time and greater flight stability.

Preferably, the shuttle article is formed in one piece of molded plastic containing lead or iron filings for desired weighting of the article, and has a detachable rubber bottom portion. The chute member is divided into thinly webbed sections by eight ribs which taper from the neck to the outer edges of the chute, with one of the webbed sections being deleted to achieve improved inverted flight.

It is a particular object of this invention to provide a shuttle article having a low center of gravity and which travels upwardly and downwardly in a path more true to the vertical than prior articles.

It is a further object to provide a shuttle article which can be used individually or with a small group of persons.

It is another object of this invention to provide a shuttle article for use in developing body coordination and eye control.

It is a still further object of this invention to provide a shuttle device for use by soccer players to develop ball control.

DESCRIPTION OF THE DRAWINGS

The above and other objects of the invention will be apparent from the ensuing description and appended claims.

One embodiment of the invention is shown by way of example in the accompanying drawings, in which.

DESCRIPTION OF PREFERRED EMBODIMENTS

Figure 2:
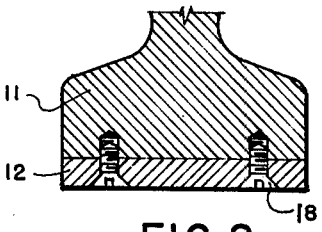
FIG. 2 is a fragmentary section taken along line 2—2 of FIG. 1 showing an alternate bottom portion.

Referring to the drawings, shuttle article 10 has a base member 11 which is weighted to obtain a low center of gravity. The base member 11 has a detachable bottom portion 12 formed of rubber and attached as shown in FIG. 2. The base member 11 is formed continuously with neck portion 13, which is set no more than one inch above the bottom of the base member to further assure a low center of gravity. Chute member 14 flares out from the neck portion 13 to an outer diameter at least twice that of the base member. The chute member 14 is formed continuously with thinly webbed sections 15, supported by eight tapering ribs 16.

The entire structure of the shuttle article 10, except for the detachable rubber bottom 12, is formed in one piece of plastic containing iron or lead filings to provide desired weight distribution.

As an especially preferred feature of this invention, one of the webbed sections 15 has been deleted from the chute member 14 to provide an opening 17. The opening 17 leads to improved turn-around characteristics at the perigee and apogee of flight and better vertical travel of the shuttle article.

The shuttle article is weighted, either by use of filings or otherwise, to achieve an overall weight of from ½ to 4 oz., with the center of gravity being no more than ½ inch from the bottom of the base 11. The overall height is from 3 to 4 inches, with the diameter of the base being from 1 to 2½ inches and that of the neck being from ¼ to ¾ inches.

In FIG. 2, base member 11 is shown in cross section with rubber bottom 12 secured thereto by means of nylon screws 18.

Figure 3:
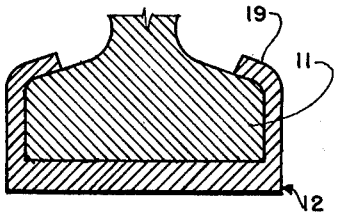
FIG. 3 is a partial section view of an alternate base of the article of FIG. 1.

In FIG. 3, the base member 11 is shown with an alternate rubber bottom 12 having a flange 19, which fits over the upper surface of the base member.

Figure 1:
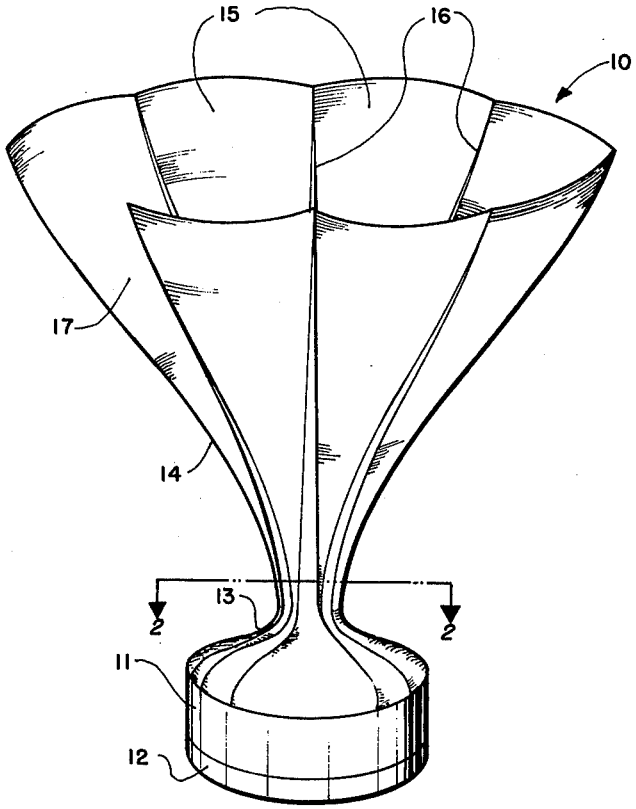
FIG. 1 is an orthographic view of the shuttle article of the present invention.

Although the webbed sections 15 (in FIG. 1) are shown as thin plastic strips, they can be of any composition to ensure structural stability and true flight. For example, they might be formed of netting material or the like so that the chute will collapse when not in use and flare out into a tear-drop shape when the article is kicked into flight.

It will thus be apparent that a new and useful shuttle article for games is provided. While a preferred embodiment and alternative base portions therefor are described, it is contemplated that various other modifications will occur to those who use the device or are otherwise familiar with it without departing from the spirit and scope of the present invention. Accordingly, it is intended that the invention be not limited to the embodiment and alternative base portions shown and described but rather be determined by reference to the claims hereinafter provided and their equivalents.

What is claimed is:

1. A shuttle article for games comprising a base member, said base member comprising a kicking surface for kicking the article into the air; and a cone-shaped chute member flaring outwardly from said base member, said chute member comprising an outer diameter at least twice that of the base member; a plurality of spaced ribs and a plurality of thinly webbed ribbed sections with at least a portion of one of said sections being removed for forming an opening extending from the outer periphery of the chute inwardly toward the base, said opening comprising substantially all of the space between at least one pair of said ribs for improving the turn-around characteristics of the article at its apogee and perigee of flight.

2. The shuttle article of claim 1 wherein the kicking surface of the base member is formed of rubber.

3. The shuttle article of claim 2 wherein the entire structure is of one piece, except for the rubber kicking surface, and is made of plastic and contains filings to give an overall weight of from about ½ to 4 ounces and a center of gravity no more than ½ inch from the bottom of the base member.

4. The shuttle article of claim 1 wherein the base member has a depth of about ½ inch and a diameter of from 1 inch to 2½ inches, and a neck portion no more than one inch from the bottom of the base member and having a diameter of from ¼ inch to ¾ inch, and wherein the chute member has a height of from 3 inches to 3½ inches.

* * * * *